US012805637B2

(12) United States Patent
Conard

(10) Patent No.: US 12,805,637 B2
(45) Date of Patent: Nov. 24, 2026

(54) ROLLING ROCKER

(71) Applicant: Michael Conard, New York, NY (US)

(72) Inventor: Michael Conard, New York, NY (US)

( * ) Notice: Subject to any disclaimer, the term of this patent is extended or adjusted under 35 U.S.C. 154(b) by 142 days.

(21) Appl. No.: 18/888,996

(22) Filed: Sep. 18, 2024

(65) Prior Publication Data

US 2025/0107623 A1 Apr. 3, 2025

Related U.S. Application Data

(60) Provisional application No. 63/586,136, filed on Sep. 28, 2023.

(51) Int. Cl.

| | |
|---|---|
| ***A47C 3/02*** | (2006.01) |
| ***A47C 3/029*** | (2006.01) |
| ***A47C 7/14*** | (2006.01) |
| ***A47C 7/44*** | (2006.01) |

(52) U.S. Cl.

CPC ..... *A47C 3/029* (2013.01); *A47C 7/14* (2013.01); *A47C 7/44* (2013.01)

(58) Field of Classification Search

CPC ..... A47C 3/029
USPC ..... 297/271.6
See application file for complete search history.

(56) References Cited

U.S. PATENT DOCUMENTS 141,918 A * 8/1873 Carpenter ..... A47D 9/053 297/131
287,721 A * 10/1883 Ranney ..... A47D 9/053 297/131
2,106,927 A * 2/1938 Kinnear ..... A47D 9/053 297/130
2,688,997 A * 9/1954 Miller ..... A47D 11/005 5/98.1
3,335,433 A * 8/1967 Stopek ..... A63H 3/52 D21/520
4,021,867 A * 5/1977 Maxwell, Jr. ..... A47D 9/053 297/270.3
4,025,107 A * 5/1977 Chippa ..... A47C 5/10 297/258.1 X
4,049,314 A * 9/1977 McGaffin ..... A47C 4/02 297/271.6 X
4,891,852 A * 1/1990 Lopez, Jr. ..... A47D 9/04 5/107
5,415,454 A * 5/1995 Fu-Tsung ..... A47D 1/08 297/271.6 X
6,024,409 A * 2/2000 Collins ..... A47C 3/029 297/271.6 X
6,704,949 B2 * 3/2004 Waldman ..... A47D 7/007 5/98.1

(Continued)

FOREIGN PATENT DOCUMENTS

DE 1928822 A1 * 12/1970 ..... A47C 3/029
DE 202020003460 U1 * 9/2020 ..... A47C 3/029

(Continued)

*Primary Examiner* — Rodney B White
(74) *Attorney, Agent, or Firm* — Carter, DeLuca & Farrell LLP

(57) ABSTRACT

A rolling rocker includes a seat, an arcuate rail disposed on a rear portion of the seat, and a leg disposed on a front portion of the seat and extending downwardly to provide a contact point with a surface. The arcuate rail extends downwardly and is configured to contact the surface to facilitate rocking in a substantially side-to-side motion relative to a seated user.

19 Claims, 10 Drawing Sheets

(56) References Cited

U.S. PATENT DOCUMENTS

| | | | | |
|---|---|---|---|---|
| 6,934,981 | B2 * | 8/2005 | Waldman | A47D 9/02 5/98.1 |
| 7,597,397 | B2 * | 10/2009 | McCoy | A47C 3/18 297/271.6 X |
| 8,240,699 | B2 * | 8/2012 | Zhong | B60B 33/0042 16/34 |
| 9,848,715 | B2 * | 12/2017 | Soriano | A47D 13/102 |
| 2005/0005353 | A1 * | 1/2005 | Waldman | A47D 9/012 5/101 |
| 2007/0007804 | A1 * | 1/2007 | Pemberton | A47D 13/107 297/260.2 |
| 2012/0216347 | A1 * | 8/2012 | Tundo | A47D 9/057 297/260.2 X |

FOREIGN PATENT DOCUMENTS

| | | | | |
|---|---|---|---|---|
| FR | 1491608 | A * | 8/1967 | A47C 3/029 |
| FR | 2979211 | A1 * | 3/2013 | A47C 4/02 |
| JP | 3027517 | U * | 8/1996 | A47C 3/029 |
| WO | WO-2009127694 | A1 * | 10/2009 | A47C 3/029 |

* cited by examiner

ROLLING ROCKER

CROSS-REFERENCE TO RELATED APPLICATION AND CLAIM OF PRIORITY

This application claims the benefit of, and priority to, U.S. Provisional Patent Application No. 63/586,136, filed on Sep. 28, 2023, the entire contents of which are hereby incorporated herein by reference.

TECHNICAL FIELD

The present disclosure relates to a rolling rocker. More specifically, an aspect of the present disclosure provides a rolling rocker.

BACKGROUND

Conventional rocking chairs and gliders have parallel rocking rails and rock in a forward to back pattern relative to a seated user. There are no existing solutions for a rocker that creates a substantially lateral or side-to-side rocking pattern. A need exists for improved rockers, that are able to provide an enhanced rocking motion.

SUMMARY

An aspect of the present disclosure provides a rolling rocker that includes a seat, an arcuate rail connected to the seat, the arcuate rail configured to contact a surface to facilitate rocking in a substantially side-to-side motion relative to a seated user, and a leg disposed on a front portion of the seat and extending downwardly to provide a contact point with the surface. In another aspect of the present disclosure, the arcuate rail may be connected to the seat by at least one leg extending at a predetermined angle from a vertical axis of the rolling rocker such that the arcuate rail follows a radial path along the surface during rocking motion.

In another aspect of the present disclosure, the at least one leg may be connected to the seat at an angle of about 10 degrees to about 20 degrees relative to the vertical axis of the rolling rocker.

In another aspect of the present disclosure, the arcuate rail may include a curved portion including two end portions. Each of the two end portions may terminate in a tangent portion, each tangent portion being configured to inhibit tipping over of the rolling rocker.

In another aspect of the present disclosure, the leg may be configured as a pivot point for the substantially side-to-side motion.

In another aspect of the present disclosure, the arcuate rail may be connected to the seat by one or more supports.

In another aspect of the present disclosure, the arcuate rail may define a substantially tubular cross-section.

An aspect of the present disclosure provides a rolling rocker including a seat, an arcuate rail, and a leg. The seat includes a frame and a cushion mounted to the frame. The cushion has a cross-section that follows a logarithmic curve. The cushion is configured to provide support for a seated user. The arcuate rail is disposed on a rear portion of the seat, the rail extending downwardly and configured to contact a surface to facilitate rocking in a substantially side-to-side motion relative to a seated user. The leg is disposed on a front portion of the seat and extends downwardly to provide a contact point with the surface.

In another aspect of the present disclosure, a portion of the cushion may be configured to at least partially surround the frame.

In another aspect of the present disclosure, the cushion may be comprised of steel.

In another aspect of the present disclosure, the cushion may include a face portion covered by a compressible material.

In another aspect of the present disclosure, the rolling rocker may further include a back. The back may include a back frame and a back cushion, wherein the back cushion may have a cross-section that follows a logarithmic curve. The back cushion may be configured to provide support for a back of a user.

In another aspect of the present disclosure, the at least one leg may be connected to the seat at an angle of about 10 degrees to about 20 degrees relative to the vertical axis of the rolling rocker.

In another aspect of the present disclosure, the arcuate rail may include a curved portion including two end portions. Each of the two end portions terminates in a tangent portion, each tangent portion being configured to inhibit tipping over of the rolling rocker.

In another aspect of the present disclosure, the leg may be configured as a pivot point for the substantially side-to-side motion.

In another aspect of the present disclosure, the rolling rocker may further include a back. The back may include a back frame and a back spring cushion. The back spring cushion may have a cross-section that follows a logarithmic curve, wherein the back spring cushion is configured to provide support for a back of a user.

An aspect of the present disclosure provides a rolling rocker including a seat, an arcuate rail, and a leg. The seat includes a frame and a seat cushion assembly. The seat cushion assembly defines a split construction having a left-side portion and a right-side portion each mounted to the frame, and defines a longitudinal gap therebetween. Each of the left-side portion and the right-side portion defines a cross-section that follows a logarithmic curve. The seat cushion assembly is configured to provide support for a seated user's back. The arcuate rail is disposed on a rear portion of the seat, the rail extending downwardly and configured to contact a surface to facilitate rocking in a substantially side-to-side motion relative to a seated user. The leg is disposed on a front portion of the seat and extends downwardly to provide a contact point with the surface.

An aspect of the present disclosure provides a rolling rocker including: a seat including at least one panel; a rear leg including an arcuate rail connected to the seat, the arcuate rail configured to contact a surface to facilitate rocking in a substantially side-to-side motion relative to a seated user; and a triangular front leg disposed on bottom surface of the seat and extending downwardly to provide a contact point with the surface In another aspect of the present disclosure, the rolling rocker may further include a back connected to the seat.

In another aspect of the present disclosure, the back may include a backrest portion and at least two sides substantially perpendicular to the backrest portion In another aspect of the present disclosure, the front leg may be configured as a pivot point for the substantially side-to-side motion.

Further details and aspects of the present disclosure are described in more detail below with reference to the appended figures.

BRIEF DESCRIPTION OF THE DRAWINGS

A better understanding of the features and advantages of the present disclosure will be obtained by reference to the following detailed description that sets forth illustrative aspects, in which the principles of the present disclosure are utilized, and the accompanying figures of which.

DETAILED DESCRIPTION

Figure 1:
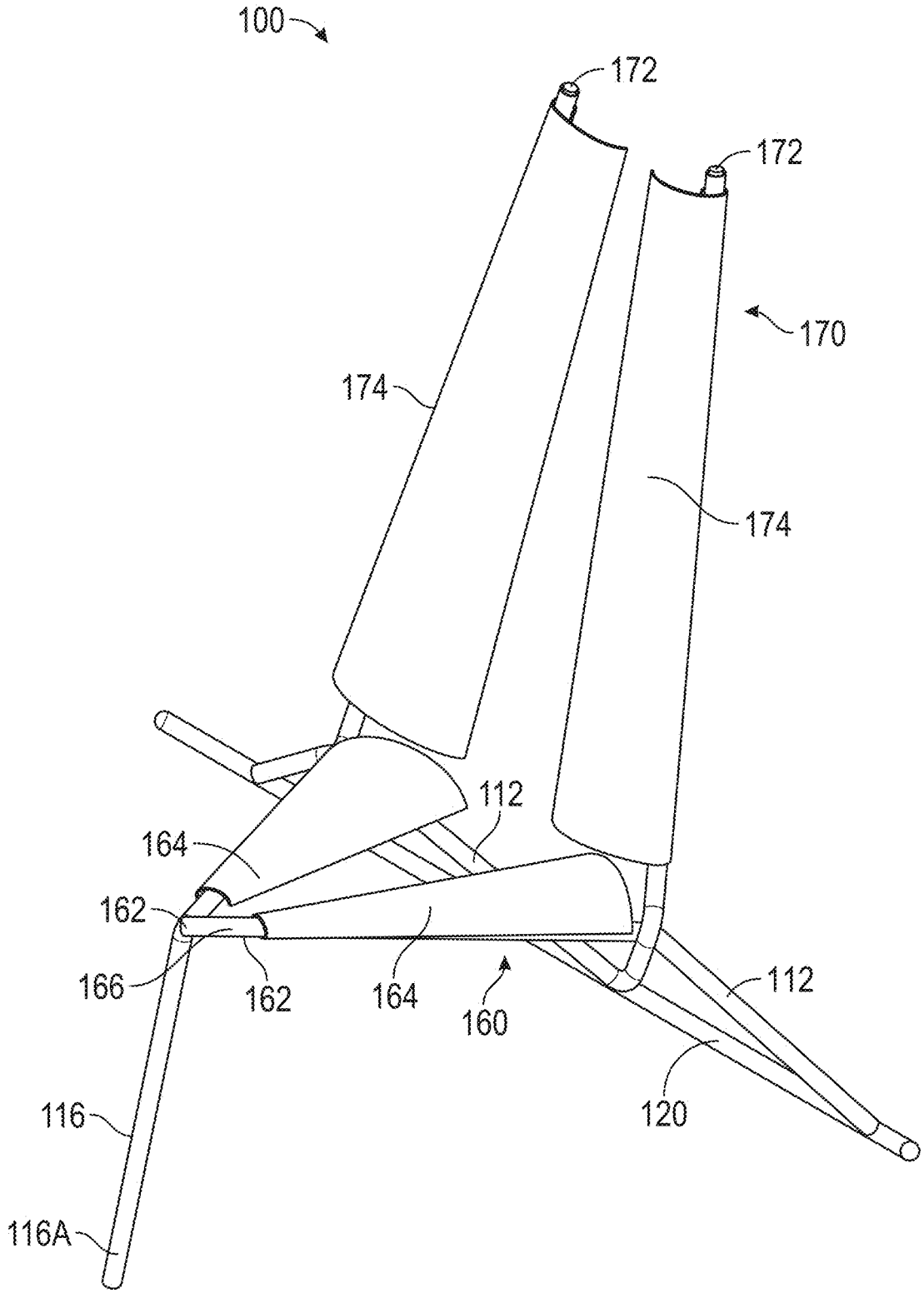
FIG. 1 is a front perspective view of one illustrative embodiment of a rolling rocker, in accordance with aspects of the present disclosure.
Figure 2:
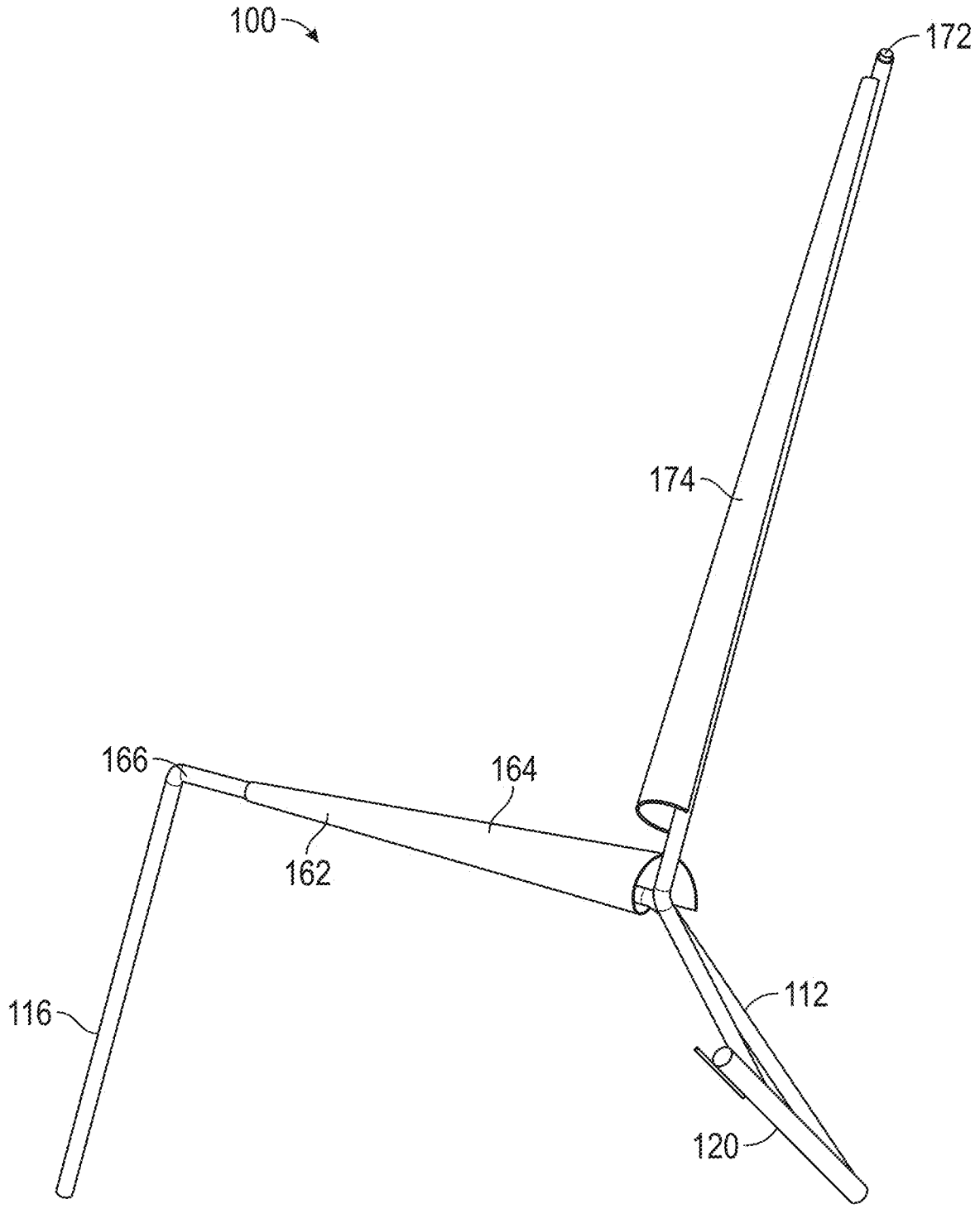
FIG. 2 is a side view of the rolling rocker of FIG. 1, in accordance with aspects of the present disclosure.

The present disclosure relates to an apparatus for propulsion. Aspects of the present disclosure are described in detail with reference to the figures, wherein like reference numerals identify similar or identical elements.

Although the present disclosure will be described in terms of specific aspects and examples, it will be readily apparent to those skilled in this art that various modifications, rearrangements, and substitutions may be made without departing from the spirit of the present disclosure. The scope of the present disclosure is defined by the claims appended hereto.

For purposes of promoting an understanding of the principles of the present disclosure, reference will now be made to exemplary aspects illustrated in the figures, and specific language will be used to describe the same. It will nevertheless be understood that no limitation of the scope of the present disclosure is thereby intended. Any alterations and further modifications of the novel features illustrated herein, and any additional applications of the principles of the present disclosure as illustrated herein, which would occur to one skilled in the relevant art and having possession of this disclosure, are to be considered within the scope of the present disclosure.

Referring to FIGS. 1-4, a rolling rocker is shown generally as rolling rocker 100. Rolling rocker 100 generally includes a seat 160, a back 170, an arcuate rail 120 connected to a rear portion of seat 160, a leg 116 disposed connected to a front portion 166 of seat 160. Leg 116 extends downwardly to provide a contact point with a surface, and at least one leg connecting seat 160 to arcuate rail 120.

Figure 5:
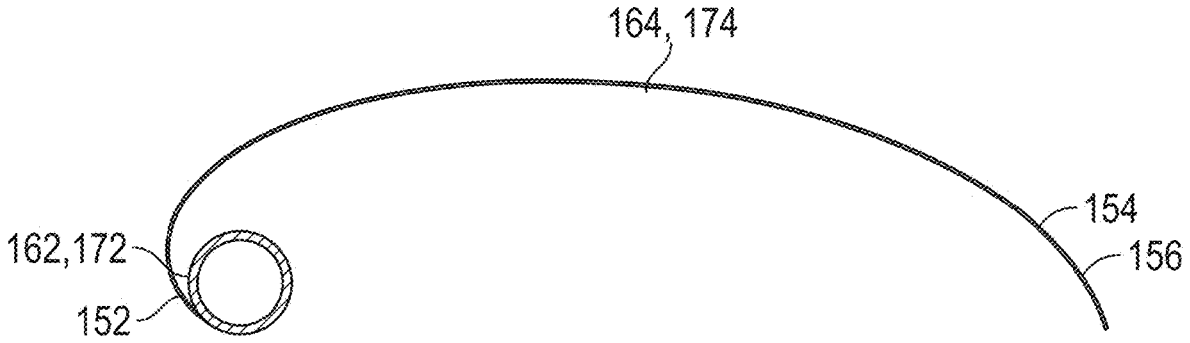
FIG. 5 is a top view of a cushion of the rolling rocker of FIG. 1, in accordance with aspects of the present disclosure.
Figure 6:
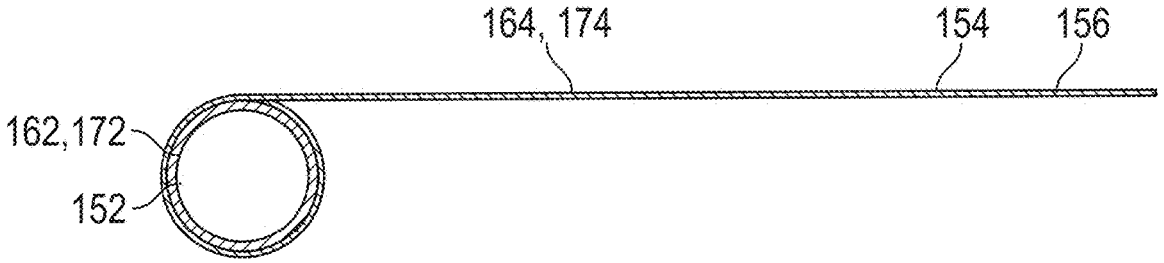
FIG. 6 is a top view of another example aspect of the cushion of the rolling rocker of FIG. 1, in accordance with aspects of the present disclosure.

Seat 160 generally includes a frame 162 and a seat cushion 164 mounted to frame 162. Seat cushion 164 (i.e., spring cushion) has a cross-section that may follow a logarithmic curve (FIG. 5) or may be flat (FIG. 6). Frame 162 may have a tubular cross-section. Although a tubular cross-section is described, other suitable shape cross-sections are contemplated. Frame 162 may be made of aluminum, steel, or other suitable material. Seat 160 may be any suitable shape, for example, a triangular shape, an oval shape, a square shape, and/or a round shape. Seat 160 may include a foam cushion.

Back 170 generally includes a back frame 172 and a back cushion 174 configured to provide support for a back of a user. Back spring cushion 174 may have a cross-section that follows a logarithmic curve (FIG. 5). Back frame 172 may have a tubular cross-section. Although a tubular cross-section is described, other suitable shape cross-sections are contemplated. Back frame 172 may be made of aluminum, steel, or other suitable material.

Figure 3:
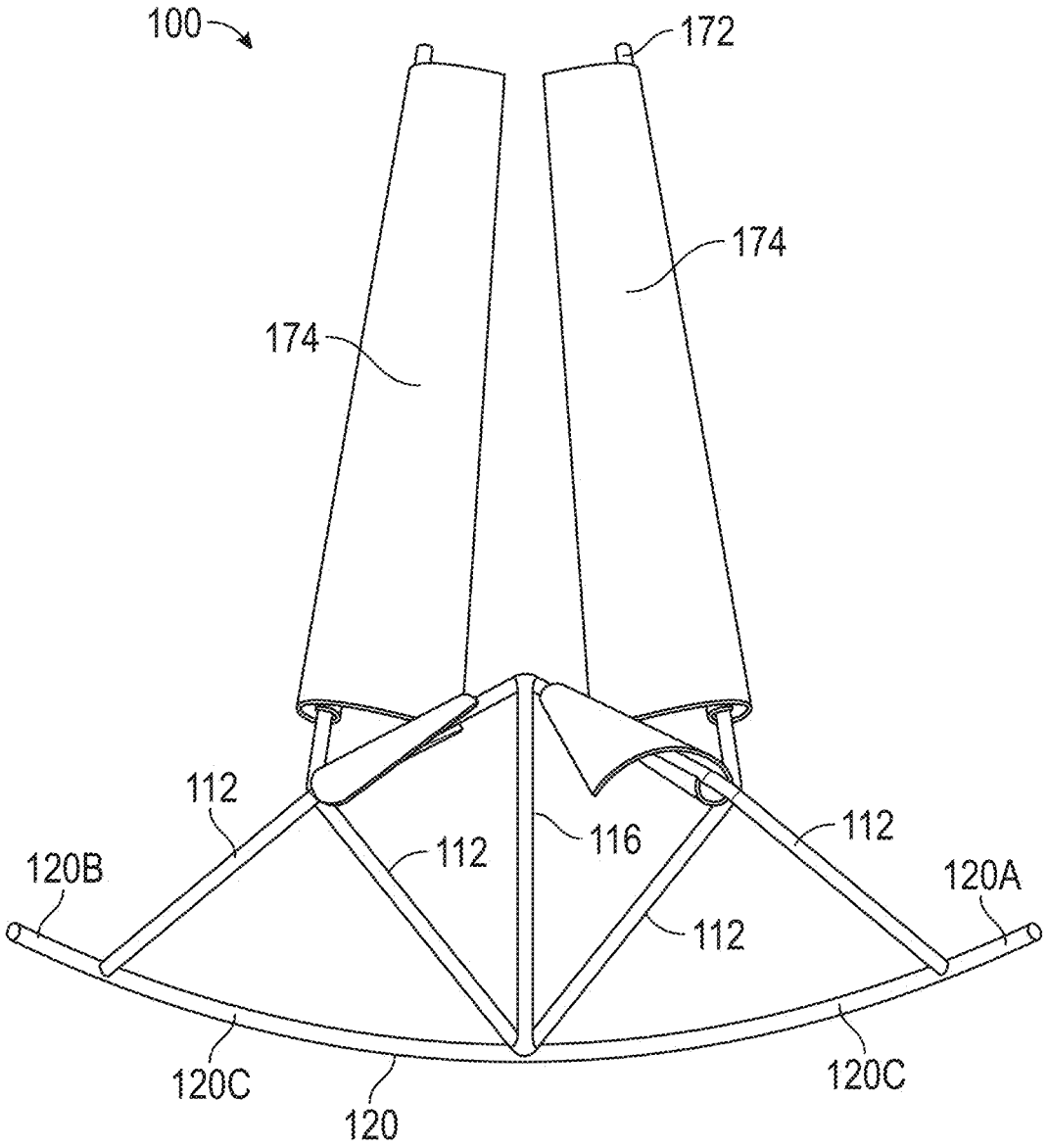
FIG. 3 is a front view of the rolling rocker of FIG. 1, in accordance with aspects of the present disclosure.
Figure 4:
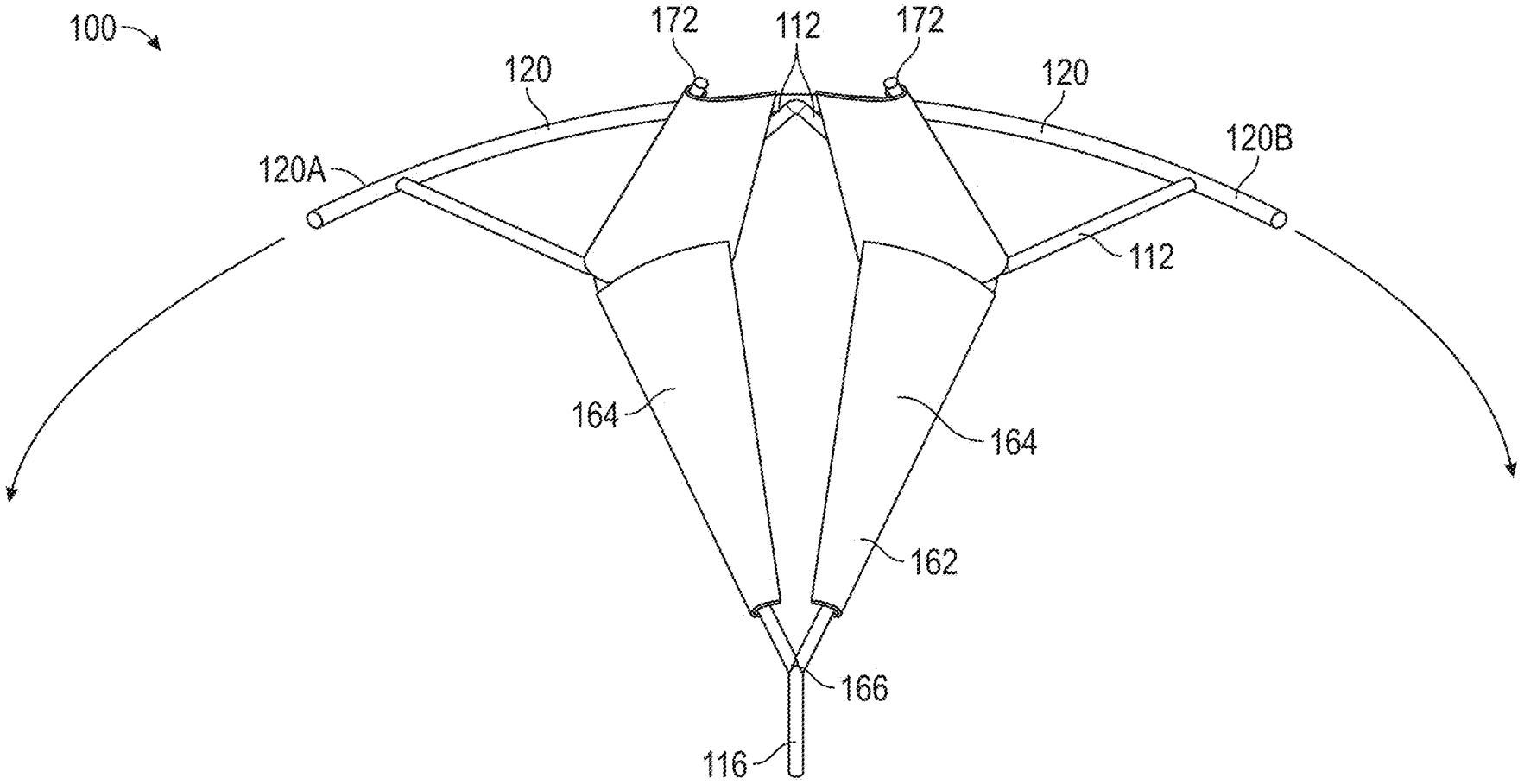
FIG. 4 is a top view of the rolling rocker of FIG. 1, in accordance with aspects of the present disclosure.

Arcuate rail 120 generally includes a curved portion including two end portions 120A, 120B (FIG. 3). Arcuate rail 120 may define a substantially tubular cross-section. Each of the two end portions 120A, 120B terminates in a tangent portion 120C (FIGS. 3 and 4), each tangent portion 120C being configured to inhibit tipping over of rolling rocker 100. Arcuate rail 120 rail may define a radius of, for example, about 32 inches to about 45 inches. Arcuate rail 120 extends downwardly from seat 160 and is configured to contact the surface to facilitate rocking in a substantially side-to-side motion relative to a seated user. The substantially side-to-side motion may include semi-conical motion and/or arcuate motion (FIG. 4). Arcuate rail 120 is connected to seat 160 by at least one leg 112. The at least one leg 112 may extend at a predetermined angle (e.g., between about 35 degrees to about 55 degrees) from a vertical axis of rolling rocker 100 such that arcuate rail 120 follows a radial path along the surface during rocking motion. In aspects, arcuate rail 120 may be connected to seat 160 by four legs 112 in an "M" configuration (FIG. 4).

Leg 116 is connected to seat 160. Leg 116 may be connected to seat 160, for example, at an angle of between about 10 degrees to about 20 degrees relative to the vertical axis of rolling rocker 100. An end portion 116A of leg 116 may be rounded to enhance the pivoting action of leg 116 during rocking.

Figure 7:
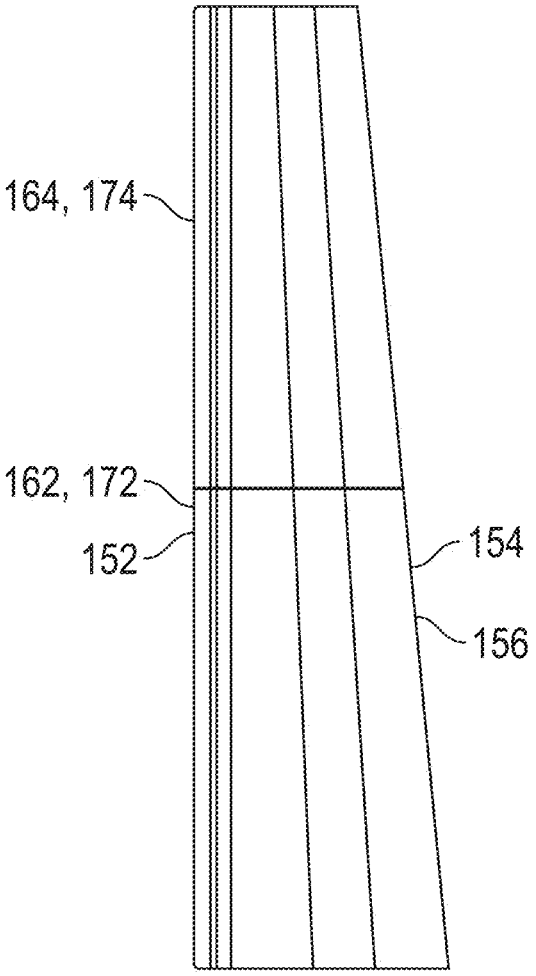
FIG. 7 is a side view of the cushion of the rolling rocker of FIG. 1, in accordance with aspects of the present disclosure.
Figure 8:
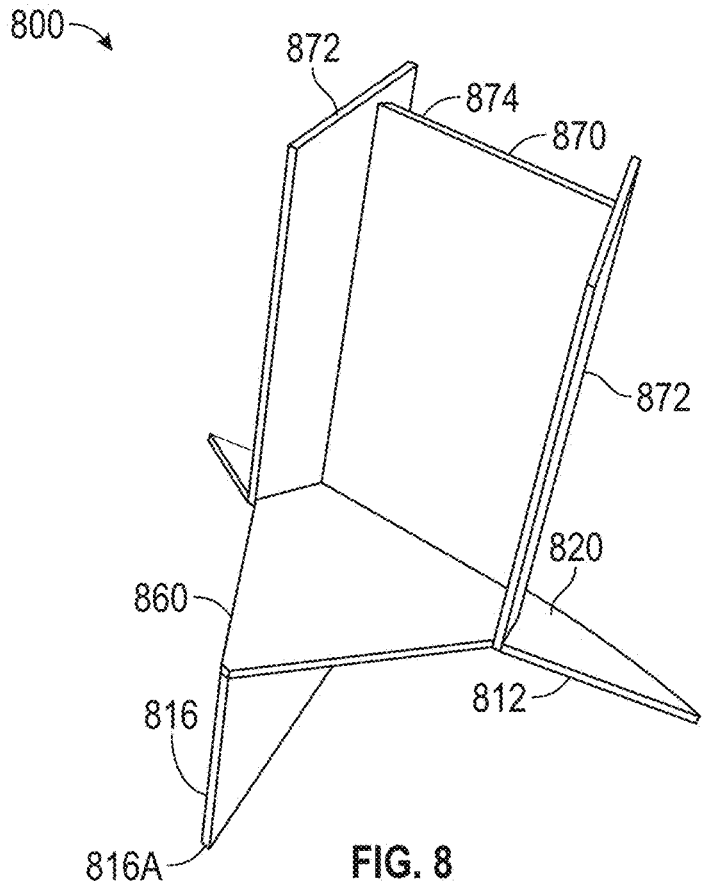
FIG. 8 is a front perspective view of one illustrative embodiment of a rolling rocker, in accordance with aspects of the present disclosure.
Figure 9:
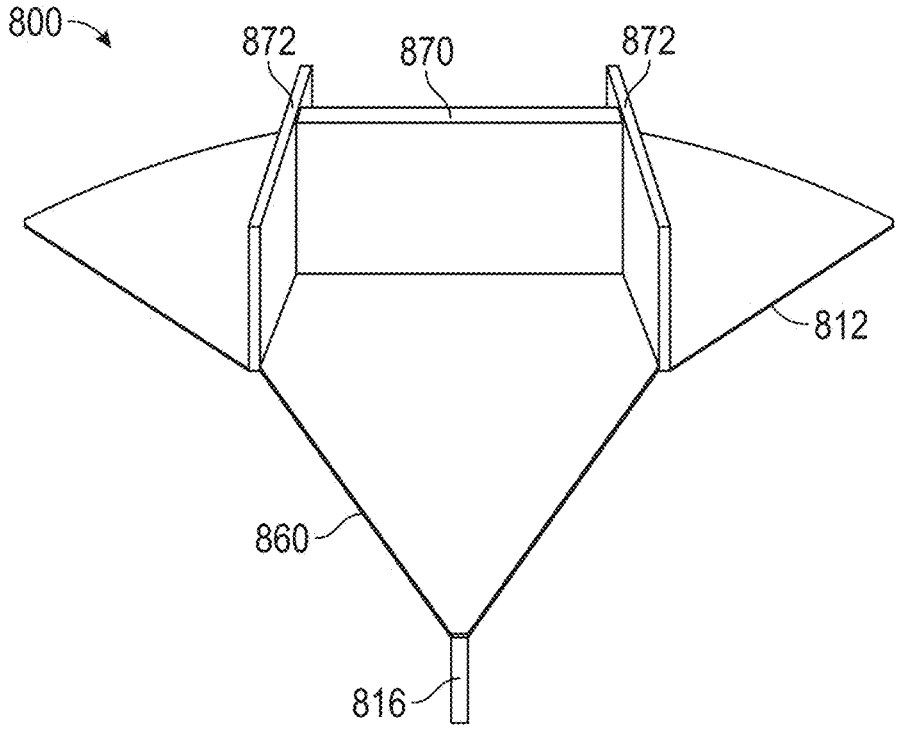
FIG. 9 is a top view of the rolling rocker of FIG. 8, in accordance with aspects of the present disclosure.

Referring to FIGS. 5-7, cushions 164, 174 have a cross-section that may follow a logarithmic curve (FIG. 5) or may be flat (FIG. 6). Cushions 164, 174 are configured to provide support for a seated user. A portion 152 of cushions 164, 174 is configured to at least partially surround frames 162, 172. Cushions 164, 174 may be comprised of spring steel or another metal. Spring cushions 164, 174 include a face portion 154 covered by a compressible material 156, for example, foam and/or fabric.

Referring to FIGS. 8-12, another example embodiment of a rolling rocker is shown generally as rolling rocker 800. Rolling rocker 800 generally includes a seat 860, a back 870, a rear leg 820 connected to a rear portion of seat 860, a front leg 816 disposed connected to a front portion 866 of seat 860. Front leg 816 extends downwardly to provide a contact point with a surface. Front leg 816 (i.e., triangular front leg) may be triangularly shaped to provide support under seat 860. Although a triangular shape is described, other suitable shapes are contemplated, such as a curved shape. Seat 860 may include a foam cushion. Seat 860 may be at an angle of about 15 degrees relative to the surface, although other angles are contemplated. Seat 860 may be about 1 foot 9 inches long, although other sizes are contemplated.

Back 870 generally includes two sides 872 (e.g., side panels) and a backrest portion 874 (e.g., a central panel) configured to provide support for a back of a user. Backrest portion 874 may include a cushion (not shown). Sides 872 and backrest portion 874 may have a flat cross-section. Although a flat cross-section is described, other suitable shape cross-sections are contemplated. For example, sides 872 and backrest portion 874 may have an arched cross-section. Sides 872 may be made of aluminum, plastic, steel, or other suitable material. Backrest portion 874 may be at an angle of about 15 degrees relative to the surface.

Sides 872 may be substantially perpendicular to backrest portion 874. However, sides 872 may be at an angle, for example of 45 degrees relative to backrest portion 874. Sides 872 can be connected to the backrest portion 874 using several methods, such as the use of mechanical fasteners such as screws or bolts. For instance, sides 872 may include pre-drilled holes that align with corresponding holes on the backrest portion 874, enabling screws to secure the sides 872 together firmly. Alternatively, brackets or corner plates may be sued to affix sides 872 to backrest portion 874, which are attached to the edges of the ides 872 and backrest portion 874 to create a stable connection. For example, metal brackets may be attached to the inner edges of the sides 872, and these brackets would then be fastened to the backrest portion 874, providing both strength and alignment. In another example, sides 872 may have a recess. The edges of backrest portion 874 may sit in the recess. In a design where aesthetics and a clean look are important, adhesives, or welding (for metal panels) may be used. Adhesives such as industrial-strength epoxy may be used to bond the sides 872 together, ensuring a seamless connection without visible fasteners. Alternatively, if the sides 872 are metal, they might be welded at the joints, creating a strong, permanent bond that is visually unobtrusive.

Figure 10:
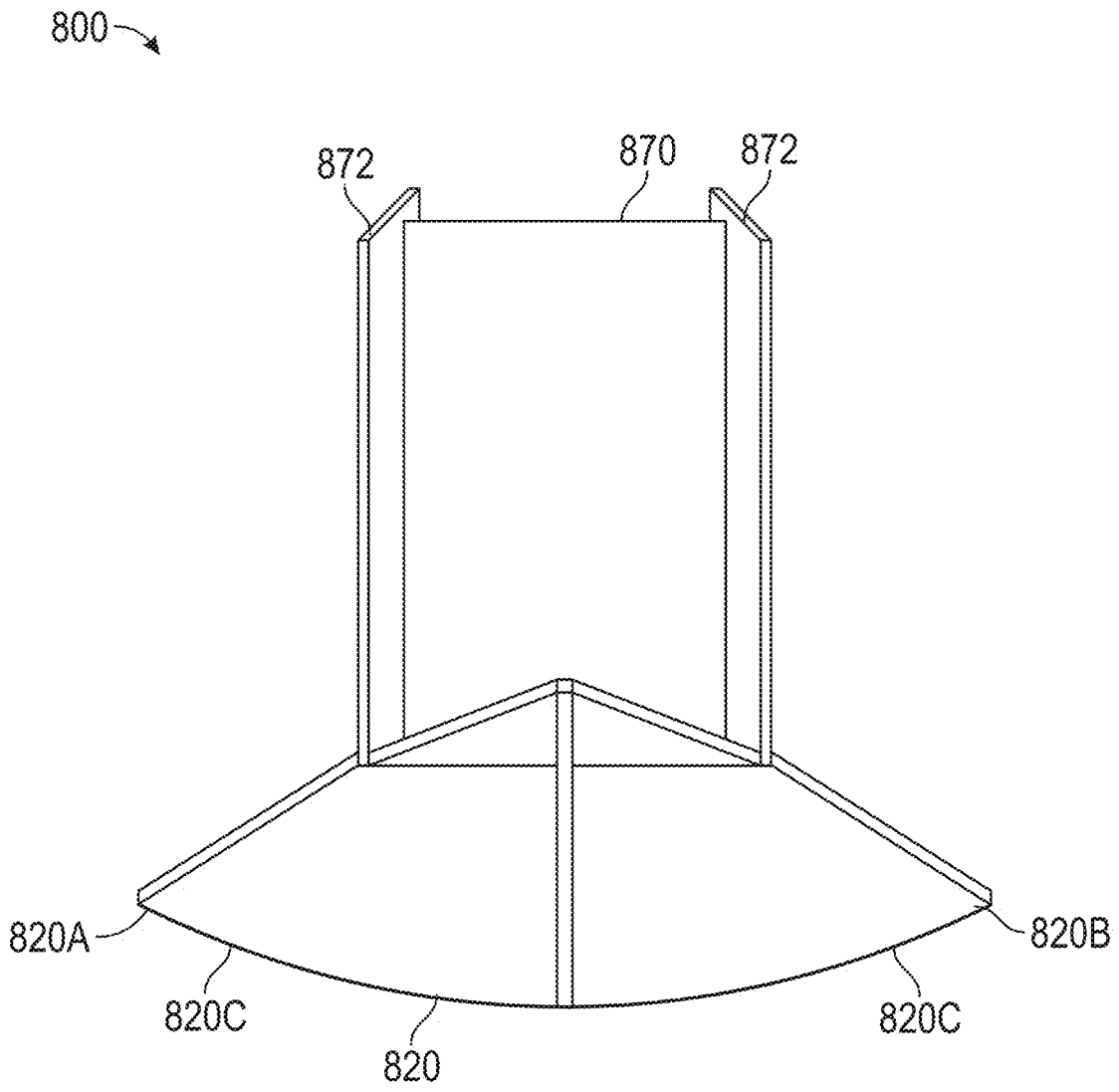
FIG. 10 is a front elevation view of the rolling rocker of FIG. 8, in accordance with aspects of the present disclosure.

Rear leg 820 may be comprised of a single panel. Rear leg 820 may include an arcuate rail 820 that generally includes a curved portion including two end portions 820A, 820B (FIG. 10). Arcuate rail 820 may include a surface that defines a substantially square or rounded cross-section. Each of the two end portions 820A, 820B terminates in a tangent portion 820C (FIGS. 10 and 11), each tangent portion 820C being configured to inhibit tipping over of rolling rocker 800. Each tangent portion may be about five inches long.

Figure 11:
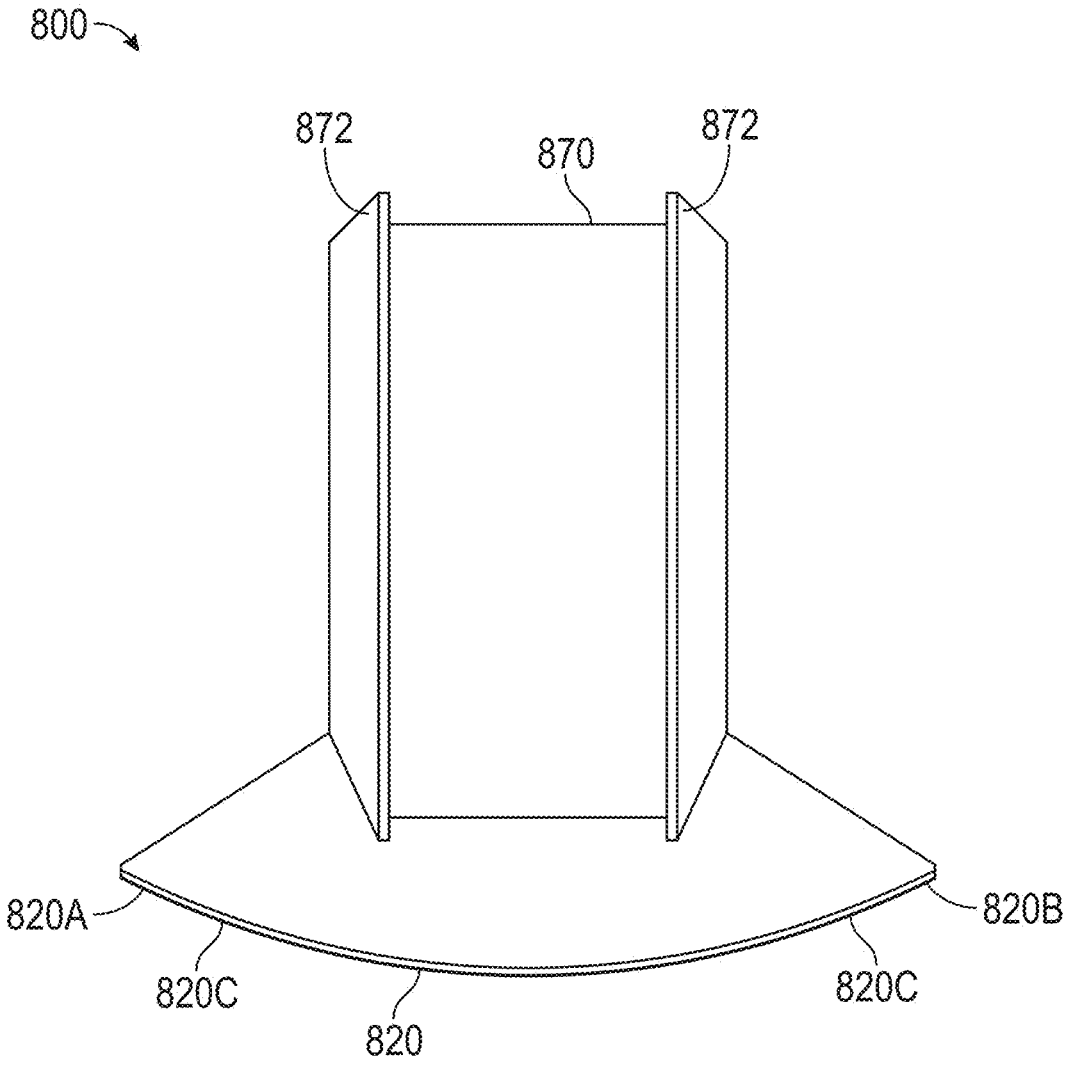
FIG. 11 is a rear elevation view of the rolling rocker of FIG. 8, in accordance with aspects of the present disclosure.
Figure 12:
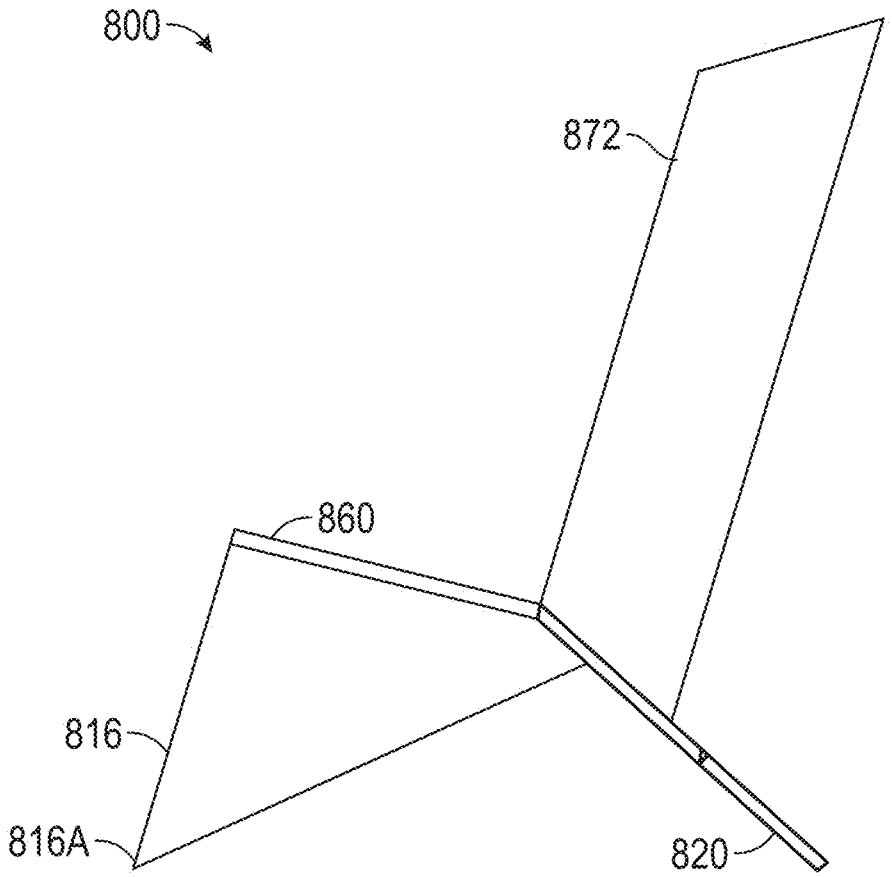
FIG. 12 is a side elevation view of the rolling rocker of FIG. 8, in accordance with aspects of the present disclosure.

Arcuate rail 820 rail may define a radius of, for example, about three feet two and a half inches. Arcuate rail 820 extends downwardly from seat 860 and is configured to contact the surface to facilitate rocking in a substantially side-to-side motion relative to a seated user. The substantially side-to-side motion may include semi-conical motion and/or arcuate motion (FIG. 11). Arcuate rail 820 is connected to seat 160 by rear leg 812. Rear leg 812 may extend at a predetermined angle (e.g., between about 35 degrees to about 55 degrees) from a vertical axis of rolling rocker 800 such that arcuate rail 820 follows a radial path along the surface during rocking motion.

Leg 816 is connected to seat 860. Leg 816 may be connected to seat 860, for example, at an angle of between about 10 degrees to about 20 degrees relative to the vertical axis of rolling rocker 100. An end portion 816A of leg 816 may be rounded to enhance the pivoting action of leg 816 during rocking. The distance between the arcuate rail 820 and end portion 816A of leg 816 may be about two feet nine and a half inches.

Certain aspects of the present disclosure may include some, all, or none of the above advantages and/or one or more other advantages readily apparent to those skilled in the art from the figures, descriptions, and claims included herein. Moreover, while specific advantages have been enumerated above, the various aspects of the present disclosure may include all, some, or none of the enumerated advantages and/or other advantages not specifically enumerated above.

The aspects disclosed herein are examples of the disclosure and may be embodied in various forms. For instance, although certain aspects herein are described as separate aspects, each of the aspects herein may be combined with one or more of the other aspects herein. Specific structural and functional details disclosed herein are not to be interpreted as limiting, but as a basis for the claims and as a representative basis for teaching one skilled in the art to variously employ the present disclosure in virtually any appropriately detailed structure. Like reference numerals may refer to similar or identical elements throughout the description of the figures.

The phrases "in an embodiment," "in aspects," "in various aspects," "in some aspects," or "in other aspects" may each refer to one or more of the same or different example Aspects provided in the present disclosure. A phrase in the form "A or B" means "(A), (B), or (A and B)." A phrase in the form "at least one of A, B, or C" means "(A); (B); (C); (A and B); (A and C); (B and C); or (A, B, and C)."

It should be understood that the foregoing description is only illustrative of the present disclosure. Various alternatives and modifications can be devised by those skilled in the art without departing from the disclosure. Accordingly, the present disclosure is intended to embrace all such alternatives, modifications, and variances. The aspects described with reference to the attached figures are presented only to demonstrate certain examples of the disclosure. Other elements, steps, methods, and techniques that are insubstantially different from those described above and/or in the appended claims are also intended to be within the scope of the disclosure.

What is claimed is:

1. A rolling rocker comprising:

a seat;

an arcuate rail connected to the seat, the arcuate rail configured to contact a surface to facilitate rocking in a substantially side-to-side motion relative to a seated user; and an elongated leg disposed on a front portion of the seat and extending downwardly therefrom at a location aligned with a center point of the arcuate rail to provide a contact point with the surface.

2. The rolling rocker of claim 1, wherein the arcuate rail is connected to the seat by at least one leg extending at a predetermined angle from a vertical axis of the rolling rocker such that the arcuate rail follows a radial path along the surface during rocking motion.

3. The rolling rocker of claim 2, wherein the at least one leg is connected to the seat at an angle of about 10 degrees to about 20 degrees relative to the vertical axis of the rolling rocker.

4. The rolling rocker of claim 1, wherein the arcuate rail includes:

a curved portion including two end portions; and wherein each of the two end portions terminates in a tangent portion, each tangent portion being configured to inhibit tipping over of the rolling rocker.

5. The rolling rocker of claim 1, wherein the elongated leg is configured as a pivot point for the substantially side-to-side motion.

6. The rolling rocker of claim 1, wherein the arcuate rail is connected to the seat by one or more supports.

7. The rolling rocker of claim 1, wherein the arcuate rail defines a substantially tubular cross-section.

8. A rolling rocker comprising:

a seat including:

a frame; and a spring cushion mounted to the frame, wherein the spring cushion has a cross-section that follows a logarithmic spiral curve, wherein the spring cushion is configured to provide support for a seated user;

an arcuate rail disposed on a rear portion of the seat, the rail extending downwardly and configured to contact a surface to facilitate rocking in a substantially side-to-side motion relative to a seated user; and an elongated leg disposed on a front portion of the seat and extending downwardly therefrom at a location aligned with a center point of the arcuate rail to provide a contact point with the surface.

9. The rolling rocker of claim 8, wherein a portion of the spring cushion is configured to at least partially surround the frame.

10. The rolling rocker of claim 8, wherein the spring cushion includes a face portion covered by a compressible material.

11. The rolling rocker of claim 10, wherein the arcuate rail is connected to the seat by at least one leg extending at a predetermined angle from a vertical axis of the rolling rocker such that the arcuate rail follows a radial path along the surface during rocking motion.

12. The rolling rocker of claim 11, wherein the at least one leg is connected to the seat at an angle of about 10 degrees to about 20 degrees relative to the vertical axis of the rolling rocker.

13. The rolling rocker of claim 10, wherein the arcuate rail includes:

a curved portion including two end portions, and wherein each of the two end portions terminates in a tangent portion, each tangent portion being configured to inhibit tipping over of the rolling rocker.

14. The rolling rocker of claim 10, wherein the leg is configured as a pivot point for the substantially side-to-side motion.

15. The rolling rocker of claim 8, further comprising a back, wherein the back includes:

a back frame; and a back spring cushion, wherein the back spring cushion has a cross-section that follows a logarithmic spiral curve, wherein the back spring cushion is configured to provide support for a back of a user.

16. A rolling rocker comprising:

a seat comprising at least one panel;

a rear leg including an arcuate rail connected to the seat, the arcuate rail configured to contact a surface to facilitate rocking in a substantially side-to-side motion relative to a seated user; and a triangular front leg disposed on bottom surface of the seat and extending downwardly to provide a contact point with the surface.

17. The rolling rocker of claim 16, further comprising a back connected to the seat.

18. The rolling rocker of claim 17, wherein the back comprises a backrest portion and at least two sides substantially perpendicular to the backrest portion.

19. The rolling rocker of claim 16, wherein the front leg is configured as a pivot point for the substantially side-to-side motion.

* * * * *